US005553553A

United States Patent [19]

Hoeffken

[11] Patent Number: 5,553,553

[45] Date of Patent: Sep. 10, 1996

[54] FURNACE AND METHOD FOR SECURING A THERMOSTAT TO A FURNACE

[75] Inventor: Russell W. Hoeffken, Belleville, Ill.

[73] Assignee: Goodman Manufacturing Company, L.P., Houston, Tex.

[21] Appl. No.: 543,923

[22] Filed: Oct. 17, 1995

Related U.S. Application Data

[62] Division of Ser. No. 311,176, Sep. 23, 1994.

[51] Int. Cl.[6] ..... F23N 5/02

[52] U.S. Cl. ..... 110/190; 110/349; 29/513

[58] Field of Search ..... 110/190, 193, 110/349; 248/904; 403/274, 282; 29/513

[56] References Cited

U.S. PATENT DOCUMENTS

| | | | |
|---|---|---|---|
| 2,243,923 | 6/1941 | Swanstrom | 29/513 |
| 4,653,708 | 3/1987 | Rich | 248/27.1 |

*Primary Examiner*—Henry A. Bennett
*Assistant Examiner*—Susanne C. Tinker
*Attorney, Agent, or Firm*—Ben D. Tobor

[57] ABSTRACT

A warm air furnace and method for securing a thermostat to a wall of a warm air furnace utilizes a thermostat mounting flange which has its ends forced inwardly into openings formed in a wall of the furnace, and the thermostat may be secured to the wall of the furnace without the use of screws.

7 Claims, 3 Drawing Sheets

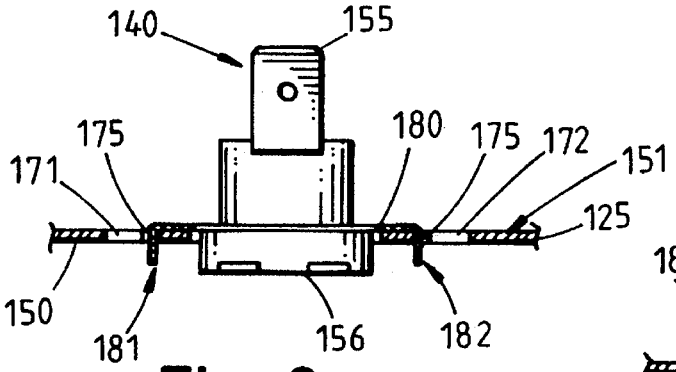
Fig. 6
Fig. 7
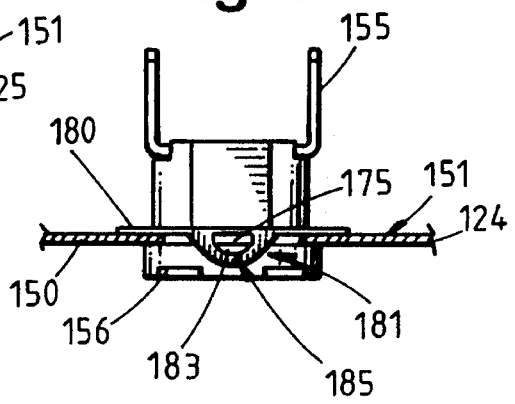
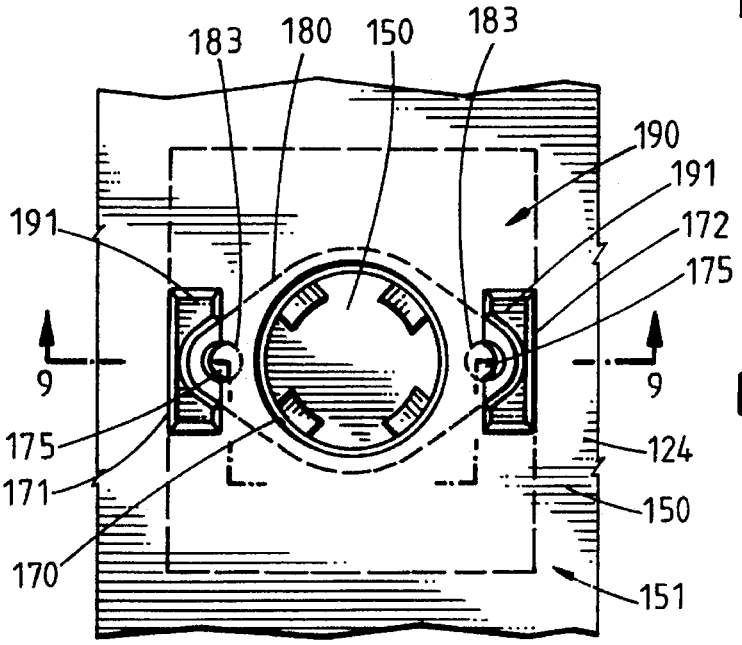
Fig. 8
Fig. 9
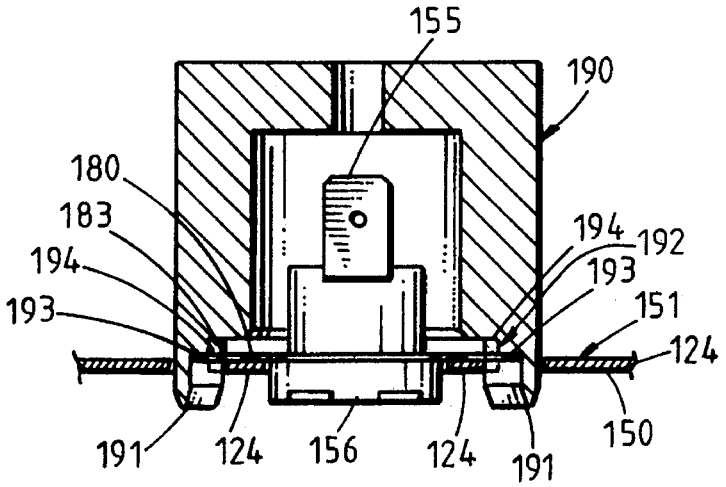

FURNACE AND METHOD FOR SECURING A THERMOSTAT TO A FURNACE

This is a division of application Ser. No. 08/311,176, filed Sep. 23, 1994.

FIELD OF THE INVENTION

The invention relates to a warm air furnace and a method for securing a thermostat to a wall of a warm air furnace.

DESCRIPTION OF THE PRIOR ART

Conventional warm air furnaces, adapted to supply heated air to a room of a residence or commercial building, typically include a plurality of thermostats, or "roll-out" switches, disposed on a burner box which contains the burner assembly which provides heated combustion gases which flow through at least one heat exchanger in the furnace. If there is a blockage in the burner assembly or heat exchanger, the flames from the burner assembly may "roll-out" of the burner box which may present a fire hazard, instead of passing through the heat exchanger. If the flame, or flames, of a burner assembly roll-out, the thermostat, or "roll-out" switch, detects an increase in the temperature beyond a predetermined temperature limit, and a signal is transmitted to the furnace controls to turn off the furnace. Conventional warm air furnaces may have up to four thermostats per furnace.

Typical thermostats may be mounted, or secured, to an outer wall surface of the furnace by spot welding a small mounting flange associated with the thermostat to a larger furnace mounting flange. The furnace mounting flange is in turn secured to an outer wall surface of the furnace, as by using two screws which attach the furnace mounting flange to the wall of the furnace. This conventional technique has certain disadvantages associated with it, including: the cost associated spot welding the thermostat mounting flange to the furnace mounting flange; the cost of the two screws for mounting each thermostat; and the labor cost associated with the spot welding step and the step of screwing the two screws into the warm air furnace.

Accordingly, prior to the development of the present warm air furnace and method for securing a thermostat to a wall of a warm air furnace, there has been no warm air furnace and method for securing a thermostat to a wall of a warm air furnace which: is economical to manufacture and use; does not require the thermostat to be spot welded to a furnace mounting flange prior to securing the thermostat to the wall of the furnace; and does not require the use of screws, and the attendant labor, to mount the thermostat to the wall of the furnace. Therefore, the art has sought a warm air furnace and method for securing a thermostat to a wall of a warm air furnace which: is economical to manufacture and use; does not require the spot welding of the thermostat to a furnace mounting flange; and does not require the use of screws, and the attendant labor, to secure the thermostat to the wall of a warm air furnace.

SUMMARY OF THE INVENTION

In accordance with one aspect of the present invention, the foregoing advantages have been achieved through the present method for securing a thermostat to a wall of a warm air furnace, the wall having an inner and an outer wall surface, and the thermostat includes a terminal connector means and a temperature sensor means. The method for securing a thermostat, in accordance with the present invention, may include the steps of: forming a first, second, and third opening in the wall, the second and third openings being disposed adjacent the first opening and opposed from each other; forming a tab, for each of the second and third openings, from a portion of the wall, the tabs being disposed within, and extending into, each of the second and third openings; providing a mounting flange for the thermostat, the mounting flange having first and second ends, and providing an opening in, and disposed adjacent to, the first and second ends of the mounting flange; disposing the mounting flange of the thermostat in an abutting relationship with the outer wall surface of the wall, with the temperature sensor means disposed within the first opening and adjacent the inner wall surface of the wall, and with the terminal connector means disposed adjacent the outer wall surface of the wall; and forcing the first and second ends of the mounting flange inwardly in to the second and third openings of the wall, with the tabs received by, and disposed within, the openings of the first and second ends of the mounting flange, whereby the thermostat is secured to the outer wall surface of the wall.

A feature of this aspect of the present invention may include the steps of forming the first opening with a circular shape and forming the second and third openings with a substantially rectangular shape. Another feature of this aspect of the present invention may include the step of disposing the second and third openings in a spaced relationship from the first opening and diametrically opposed from each other. A further feature of this aspect of the present invention may include the step of forming the tabs with a substantially semi-circular shape.

Another feature of this aspect of the present invention may include the steps of providing the first and second ends of the mounting flange with a substantially triangular shape, and providing the openings in the first and second ends of the mounting flange with a circular shape. An additional feature of this aspect of the present invention may include the step of disposing the first and second ends of the mounting flange substantially perpendicular to the inner wall surface of the wall. A further feature of this aspect of the present invention may include the step of forming a fourth and fifth opening in the wall, the fourth and fifth openings being disposed in a spaced relationship with the first opening and between the second and third openings. Another feature of this aspect of the present invention may include the steps of disposing a mounting fixture adjacent the outer wall surface of the wall, with the mounting flange disposed between the outer wall surface and the mounting fixture, and providing relative movement between the mounting fixture and the wall to force the first and second ends of the mounting flange inwardly into the second and third openings.

An additional feature of this aspect of the present invention may include the steps of providing the mounting flange with two guide projections and passing the guide projections into the second and third openings of the wall. Another feature of this aspect of the present invention may include the steps of providing the mounting fixture with a stepped recess and disposing the mounting flange of the thermostat within the stepped recess prior to forcing the first and second ends of the mounting flange into the second and third openings of the wall. An additional feature of this aspect of the present invention may include the steps of providing the mounting fixture with two guide projections, and the stepped recess is provided within the guide projections.

In accordance with another aspect of the present invention, the foregoing advantages have been achieved through the present warm air furnace. The warm air furnace, in accordance with the present invention, may include: a housing, including a plurality of walls, at least one wall having an inner and an outer wall surface; at least one heat exchanger; a burner assembly, for producing combustion gases which flow into the at least one heat exchanger; a blower, adapted to blow air over the at least one heat exchanger; at least one wall having a first opening therethrough; at least one thermostat disposed in the first opening, the at least one thermostat including a terminal connector means disposed adjacent the outer wall surface of the at least one wall, and a temperature sensor means disposed within the first opening and disposed adjacent the inner wall surface of the at least one wall; the at least one wall further having second and third openings disposed adjacent the first opening and opposed from each other, with a portion of the at least one wall forming a tab disposed within each of the second and third openings; the at least one thermostat further including a mounting flange, disposed in an abutting relationship with the outer wall surface with the at least one wall, the mounting flange having first and second ends with an opening disposed adjacent each end; and a portion of each of the first and second ends of the mounting flange are forced inwardly into the second and third openings with the openings of the first and second ends of the mounting flange having the tabs in the second and third openings being received by, and disposed within, the openings of the first and second ends of the mounting flange, whereby the at least one thermostat is secured to the outer wall surface of the at least one wall. An additional feature of this aspect of the present invention is that the first and second ends of the mounting flange may be disposed substantially perpendicular to the at least one wall surface and are disposed adjacent to the inner wall surface of the at least one wall surface.

The warm air furnace and method for securing a thermostat to a wall of a warm air furnace of the present invention, when compared with previously proposed prior art furnaces and methods, have the advantages of being: economical to manufacture and use; do not require the spot welding of a thermostat mounting flange to a furnace mounting flange; and do not require the use of screws, and the attendant labor, to mount the thermostat to the wall of the warm air furnace.

BRIEF DESCRIPTION OF THE DRAWINGS

In the drawings:

FIG. 6 is a partial cross-sectional view taken along line 6—6 of FIG. 5;

FIG. 7 is a partial cross-sectional view taken along line 7—7 of FIG. 5;

FIG. 8 is a back view of the thermostat and furnace wall of FIG. 3 with the thermostat disposed within a mounting fixture, in accordance with the present invention;

FIG. 9 is a partial cross-sectional view taken along 9—9 of FIG. 8;

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 11:
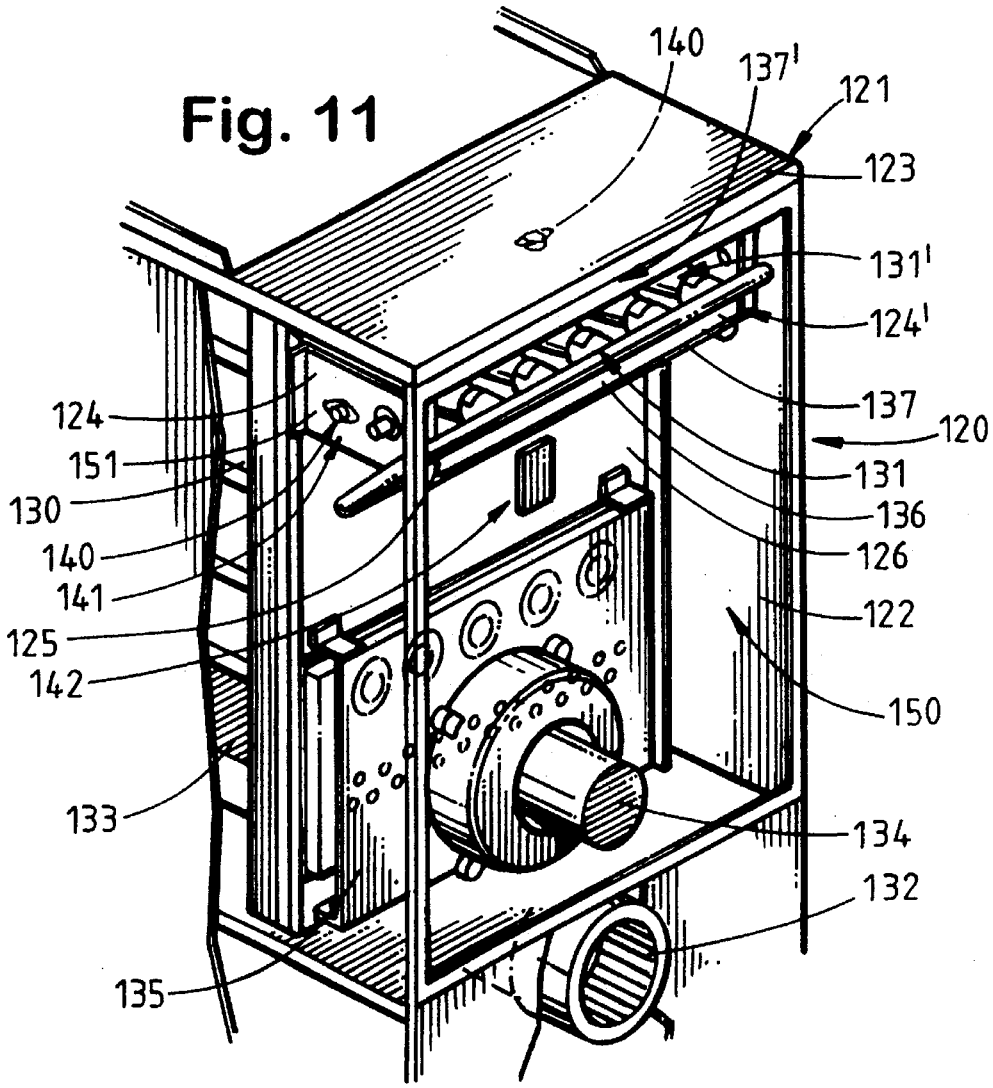
FIG. 11 is a partial, perspective view of a warm air furnace in accordance with the present invention.

With reference to FIG. 11, a warm air furnace 120 in accordance with the present invention is shown to generally include: a housing 121, including a plurality of walls 122–126; at least one heat exchanger 130; a burner assembly 131, for producing combustion gases which flow into the at least one heat exchanger 130; and a blower 132, adapted to blow air over the at least one heat exchanger 130. The embodiment of warm air furnace 120 shown in FIG. 11 is of the type generally referred to as a high efficiency warm air furnace, wherein the at least one heat exchanger 130 is a primary heat exchanger, and a secondary heat exchanger 133 is also provided, along with a venter blower 134, and a collector box 135. A manifold 136 is provided for supplying natural gas to burner assembly 131 in a conventional manner. Warm air furnace 120 may be of the same construction as the furnace illustrated and described in U.S. patent application Ser. No. 08/113,591, filed Aug. 27, 1993, and commonly assigned with the present application, and such application is incorporated by reference herein. Side wall 124 and front wall 125 form part of the burner box 141 for burner assembly 131, along with lower wall 137, side wall 124' and upper wall 137'. Housing 121 for furnace 120, in addition to upper wall 123, includes side walls 122 and 122' as is conventional in the art, along with a front panel (not shown).

Figure 1:
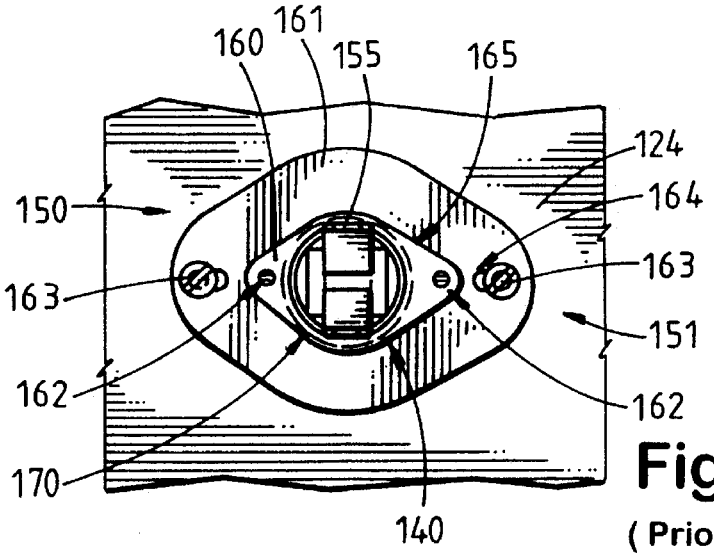
Fig. 1 ( Prior Art )
FIG. 1 is a front view of a prior art thermostat attached to an outer wall surface of a wall of a warm air furnace.

With reference to FIGS. 1 and 11, it is conventional practice to provide at least one thermostat, or roll-out switch, 140, for sensing the temperature within the burner box 141, formed by walls 124, 124', 137, 137', and 125, which contains burners 131' of burner assembly 131. The at least one thermostat 140 is used to sense the temperature within the burner box 141. If the temperature within burner box 141 exceeds a predetermined temperature limit, it is indicative of some malfunction with the furnace 120 which causes the flame, or flames, of burner assembly 131 to "roll back" into burner box 141, rather than passing into the primary heat exchanger 130. Such malfunctions could include a blockage in the burner box, or a blockage in the primary or secondary heat exchangers 130, 133. Upon the at least one thermostat 140 sensing a temperature in excess of the desired temperature limit, a signal is transmitted in a conventional manner to conventional controls, such as those illustrated at 142, whereby the operation of furnace 120 is terminated. Typically, furnace 120 is provided with four thermostats 140 which are located on the side walls 124, 124', and the lower and upper walls 137, 137' of burner box 141. If desired, additional thermostats 140 may be disposed at any desired location within housing 121 of furnace 120.

With reference to FIG. 1, the prior art method of securing a thermostat 140 to a wall of furnace 120 will be described. In FIG. 1, a portion of side wall 124 of burner box 141 is illustrated. Side wall 124, as well as the other walls, walls 122, 122', 123, 124', 125, 126, 137, and 137', each have an inner wall surface 150 (FIGS. 4 and 8) and an outer wall surface 151. The assembly process for furnace 120 typically required securing thermostats 140 to a wall of furnace 120, such as side wall 124 of burner box 141, after burner box 141 has been assembled and secured within housing 121, whereby access to the interior, or inner wall surfaces 150 of burner box 141 is not possible.

As seen in FIG. 1, a thermostat 140 has been previously secured to a wall 124 of burner box 141 in the following manner. Thermostat 140 includes: a conventional terminal connector means 155, for electrically connecting thermostat 140 to control means 142, as by a conventional wire disposed between control means 142 and terminal connector 155; and a conventional temperature sensor means 156 (see also FIG. 4). Thermostat 140 has a generally diamond-shaped mounting flange 160 associated with it. A larger, generally diamond-shaped furnace mounting flange 161 has the thermostat mounting flange 160 spot welded to it at two points, as generally shown at 162. After the mounting flanges 160 and 161 are assembled, as by spot welding, thermostat 140 along with mounting flanges 160 and 161 are secured to an outer wall surface 151 of a wall, such as wall 124, of furnace 120, as by screwing a plurality of screws 163 through furnace mounting flange 161 and into wall 124, which is typically formed of sheet metal, to secure thermostat 140 to wall 124. Furnace mounting flange 161 would typically be provided with two openings 164 through which screws 163 could pass, and wall 124 could be provided with mating openings (not shown) for the receipt of screws 163. Additionally, the wall 124 is provided with an opening 165 through which temperature sensor means 156 could pass through wall 124 to be disposed adjacent the inner wall surface 150 of wall 124.

Figure 2:
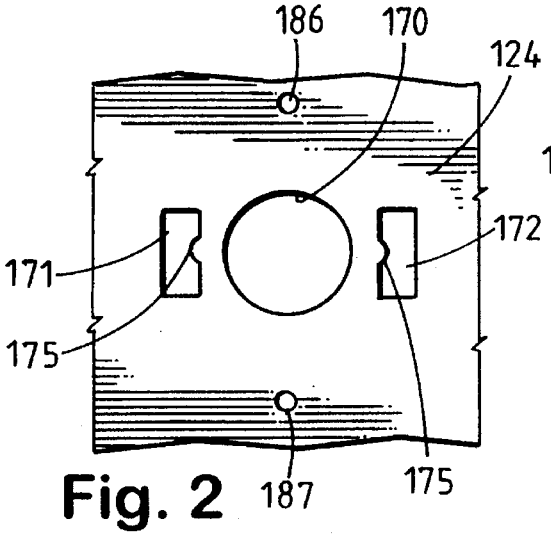
FIG. 2 is a front view of a portion of an outer wall surface of a wall of a warm air furnace, in accordance with the present invention.
Figure 3:
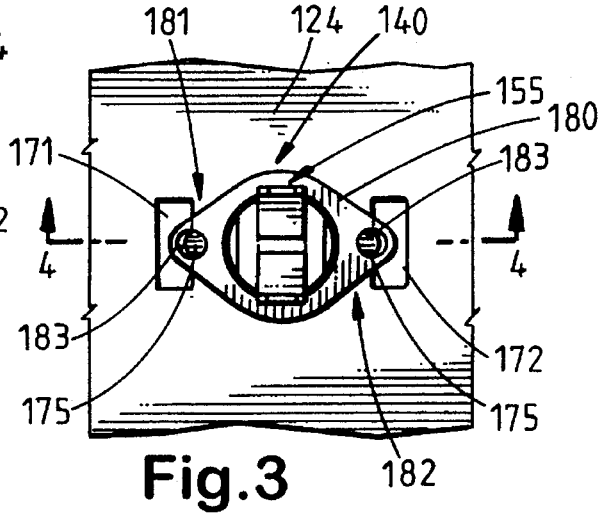
FIG. 3 is a front view of a thermostat abutting against an outer wall surface of the wall of a warm air furnace, in accordance with the present invention, prior to the thermostat being secured to the warm air furnace.
Figure 4:
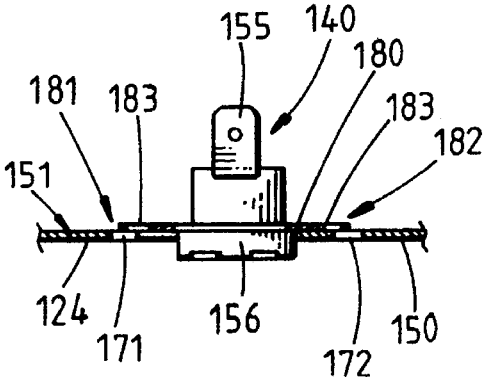
FIG. 4 is a partial cross-sectional view taken along line 4—4 of FIG. 3.

With reference to FIGS. 2–7, the method of the present invention for securing a thermostat 140 to a wall, such as side wall 124 of furnace 120 will be described. In FIGS. 2–7, a portion of side wall 124 is again illustrated, and includes an inner wall surface 150 and an outer wall surface 151. Wall 124 has formed therein first, second, and third openings 170, 171, 172, with the second and third openings 171, 172 being disposed adjacent the first opening 170 and opposed from each other. Openings 170–172 may be provided in any conventional manner such as by a stamping or punch pressing operation. First opening 170 is preferably circular in shape, and is essentially the same opening 165 illustrated in FIG. 1, and is adapted to receive the temperature sensing means 156 of thermostat 140, whereby temperature sensing means 156 is disposed within the first opening 170 and adjacent the inner wall surface 150 of wall 124, as shown in FIG. 4. It should be understood that first opening 170 can have any suitable configuration, provided the temperature sensing means 156 of thermostat 140 can pass through first opening 170 and be disposed adjacent the inner wall surface 150 of wall 124. Likewise, the circular shape of temperature sensing means 156 of thermostat 140 is used for illustrative purposes only, in that temperature sensing means 156 could have any other suitable configuration, such as square, hexagonal, etc.

Still with reference to FIGS. 2–7, for each of the second and third openings 171, 172, a tab 175 is formed from a portion of wall 124, and the tabs 175 are disposed within, and extend into, each of the second and third openings 171, 172. Preferably, the shape of second and third openings 171, 172 is substantially rectangular, and the shape of tabs 175 is generally semi-circular in shape. Preferably, tabs 175 are coplanar with the inner and outer wall surfaces 150, 151 of wall 124. Thermostat 140, including terminal connector means 155 and temperature sensor means 156, has associated therewith a mounting flange 180 having first and second ends 181, 182 and each of the first and second ends 181, 182 is provided with an opening 183 which is disposed adjacent to the first and second ends 181, 182 of mounting flange 180. Mounting flange 180 is preferably of a generally diamond-shape, whereby the first and second ends 181, 182 have a generally triangular shaped configuration, as illustrated in FIG. 3. Thermostat 140 may be associated with mounting flange 180 in any suitable manner, such as by a crimp fitting, spot welding, epoxy, or by being formed integral with temperature sensing means 156, whereby mounting flange 180 is associated with, or secured to, thermostat 140, and remains connected thereto upon exposure to the temperature levels encountered within furnace 120. Preferably, mounting flange 180 is formed of any suitable metallic material, as is known in the art.

Figure 5:
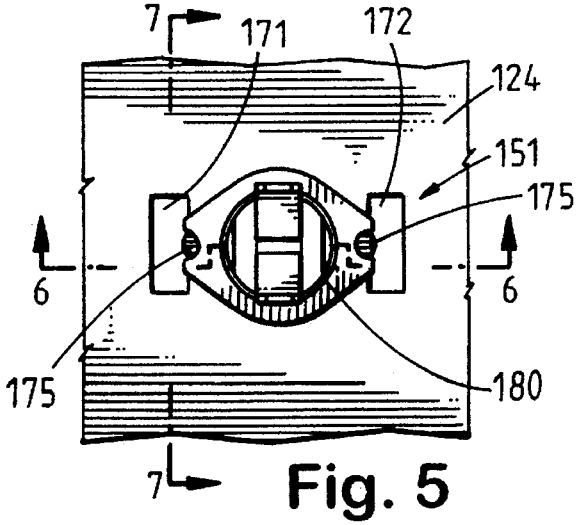
FIG. 5 is a front view of a thermostat secured to an outer wall surface of a wall of a warm air furnace, in accordance with the present invention, after the thermostat has been secured to the warm air furnace.

As illustrated in FIGS. 3 and 4, the mounting flange 180 of thermostat 140 is disposed in an abutting relationship with the outer wall surface 151 of wall 124, with the temperature sensor means 156 disposed within the first opening 170, and adjacent the inner wall surface 150 of wall 124 and with the terminal connector means 155 disposed adjacent the outer wall surface 151 of wall 124. As illustrated in FIGS. 5–7, the first and second ends 181, 182 of the mounting flange 180 are forced inwardly into the second and third openings 171, 172 of the wall 124, and the tabs 175 extending into the second and third openings 171, 172, are received by, and disposed within the openings 183 of the first and second ends 181, 182 of mounting flange 180, whereby the thermostat 140 is secured to the outer wall surface 151 of wall 124. Preferably, the first and second ends 181, 182 of mounting flange 180 are forced inwardly into first and second openings 171, 172 until they are disposed substantially perpendicular to the inner wall surface 150 of wall 124. The engagement of tabs 175 with the interior surface of openings 183, as shown at 185 in FIG. 7 secures the thermostat 140 to wall 124 of furnace 120. It should be noted that thermostat 140 may be thus secured to the outer wall surface 151 of wall 124, without gaining access to the inner wall surface 150 of wall 124, or the interior of burner box 141. Additionally, in contrast to the prior art technique of securing a thermostat to the outer wall surface of a furnace it is not necessary to: have a furnace mounting flange 161 (FIG. 1); spot weld a thermostat mounting flange, such as 160, to the furnace mounting flange 161; or use any screws 163 (FIG. 1).

Still with reference to FIGS. 2–7, it should be noted that openings 183 formed in the first and second ends 181, 182 of thermostat mounting flange 180 are preferably circular in shape; however, it should be readily understood that openings 183, as well as the shape of tabs 175 could be any other shape, such as triangular, hexagonal, etc., provided the first and second ends 181, 182 of mounting flange 180, when forced inwardly into first and second openings 171, 172, have tabs 175 received within openings 183, as generally shown at 185 in FIG. 7. Although only two ends 181, 182 of mounting flange 180 are secured to wall 124, it should be readily apparent to one of ordinary skill in the art, that additional portions of mounting flange 180 could be secured in a similar manner. For example, were mounting flange 180 to have a generally triangular shape, each of the three ends of mounting flange 180 could be secured to wall 124. Mounting flange 180 could also be of a generally square shape, and the four ends of such a mounting flange could each be secured to wall 124 in the manner previously described. As seen in FIG. 2, the second and third openings 171, 172 are preferably disposed in a spaced relationship from the first opening 170 and are diametrically opposed from each other.

As illustrated in FIG. 2, if desired, wall 124 may also have formed therein fourth and fifth openings 186, 187 which are disposed in a spaced relationship with respect to the first opening 170, and are also disposed between the first and second openings 171, 172 and diametrically opposed from each other. Should thermostat 140 malfunction after installation of the furnace, and need to be replaced by a field technician, thermostat 140 could be subjected to a sufficient outward force to force the malfunctioning thermostat 140 to be removed from wall 124. Alternatively, a small screwdriver could be inserted into second and third openings 171, 172 to force the first and second ends 181, 182 of mounting flange 180 outwardly from their engaged position with tabs 175, whereby the thermostat may be readily removed from wall 124. A replacement, or repair, thermostat, which could have the construction of the prior art thermostat of FIG. 1, including a furnace mounting flange 161, could then be secured to the outer wall surface 151 of furnace 124, as by passing screws 163 through the furnace mounting flange 161 and through fourth and fifth openings 186, 187 in wall 124.

Figure 10:
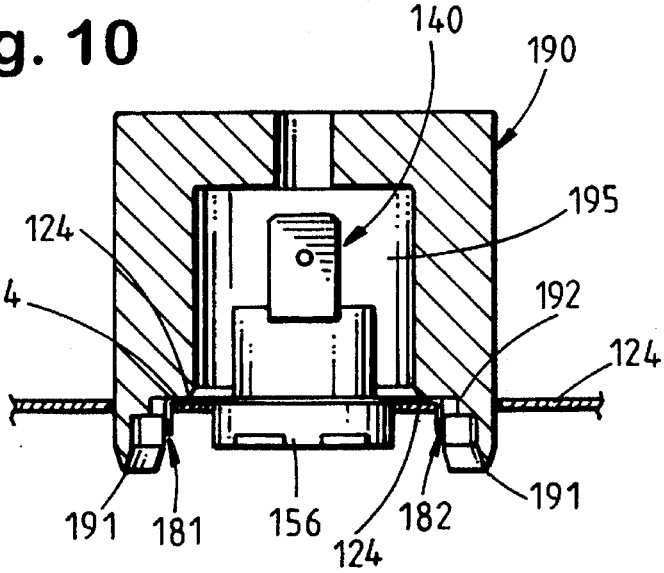
FIG. 10 is a partial cross-sectional view, similar to FIG. 9, illustrating the mounting fixture after it has secured the thermostat to the wall of the furnace, in accordance with the present invention.

With reference to FIGS. 8–10, a mounting fixture, or mounting device, 190 for use in the method of the present invention will be described. Mounting fixture 190, which is preferably formed of a suitable metallic material, is adapted for forcing the first and second ends 181, 182 of mounting flange 180 inwardly into openings 171, 172 of wall 124. Mounting fixture 190 is disposed adjacent the outer wall surface 151 of wall 124 with the mounting flange 180 disposed between the outer wall surface 151 and the mounting fixture 190. Relative movement is then provided between the mounting fixture 190 and wall 124, preferably by moving mounting fixture 190 toward wall 124, and mounting fixture 190 forces the first and second ends 181, 182 of mounting flange 180 inwardly into the second and third openings 171, 172. Preferably, the mounting fixture has two guide projections which have a generally rectangular configuration, so as to be readily received within second and third openings 171, 172 of wall 124, as relative movement between mounting fixture 190 and wall 124 is provided. Mounting fixture 190 is provided with a stepped recess 192, a stepped recess being provided in each guide projection 191, and the mounting flange 180 of thermostat 140 is disposed within the stepped recess 192 prior to forcing the first and second ends 181, 182 of the mounting flange 180 into the second and third openings 171, 172 of wall 124. Preferably, stepped recess 192 is formed with a first surface 193 which is sized to receive mounting flange 180 in its undeformed configuration as illustrated in FIGS. 3 and 9. Stepped recess 192 preferably includes a second surface 194 which forms a cavity which receives mounting flange 180 after it has been deformed, or forced inwardly, into its configuration illustrated in FIGS. 6, 7, and 10, after relative movement between mounting fixture 190 and wall 121 has been provided. Mounting fixture 190 also preferably includes an internal cavity 195 in which terminal connector means 155 and thermostat 140 may be disposed while the desired relative movement between mounting fixture 190 and wall 124 is provided. Mounting fixture 190 could be moved toward wall 124 by a human operator, or could be associated with automated equipment which moves mounting fixture 190 toward wall 124, or alternatively, wall 124 could be moved toward mounting fixture 190, which could remain stationary. Although mounting fixture 190 is illustrated as being of unitary construction, it should be readily apparent to one of ordinary skill in the art that mounting fixture 190 could be formed in two or more pieces, which would be simultaneously moved toward wall 124, or alternatively, could both remain stationary while wall 124 is moved toward mounting fixture 190.

It is to be understood that the invention is not limited to the exact details of construction, operation, exact materials, or embodiment shown and described as obvious modifications and equivalents will be apparent to one skilled in the art; for example, as previously described, the shapes of the various openings could have different shapes from those illustrated. Accordingly, the invention is therefore to be limited only by the scope of the appended claims.

I claim:

1. A warm air furnace comprising:

a housing, including a plurality of walls, at least one wall having an inner and an outer wall surface;

at least one heat exchanger;

a burner assembly, for producing combustion gases which flow into the at least one heat exchanger;

a blower, adapted to blow air over the at least one heat exchanger;

at least one wall having a first opening therethrough;

at least one thermostat disposed in the first opening, the at least one thermostat including a temperature sensor means disposed within the first opening and disposed adjacent the inner wall surface of the at least one wall;

the at least one wall further having second and third opening disposed adjacent the first openings and opposed from each other, with a portion of the at least one wall forming a tab disposed within each of the second and third openings;

the at least one thermostat further including a mounting flange, disposed in an abutting relationship with the outer wall surface of the at least one wall, the mounting flange having first and second ends with an opening disposed adjacent each end; and a portion of each of the first and second ends of the mounting flange are forced inwardly into the second and third openings, with the openings of the first and second ends of the mounting flange having the tabs in the second and third openings being received by, and disposed within, the openings of the first and second ends of the mounting flange, whereby the at least one thermostat is secured to the outer wall surface of the at least one wall.

2. The warm air furnace of claim 1, wherein the first and second ends of the mounting flange are disposed substantially perpendicular to the at least one wall surface and are disposed adjacent to the inner wall surface of the at least one wall surface.

3. The warm air furnace of claim 1, wherein the first opening has a circular shape and the second and third openings have a substantially rectangular shape.

4. The warm air furnace of claim 3, wherein the second and third openings are diametrically opposed from each other in a spaced relationship from the first opening.

5. The warm air furnace of claim 1, wherein each tab has a substantially semi-circular shape.

6. The warm air furnace of claim 1, wherein the first and second ends of the mounting flange have a substantially triangular shape, and the openings in the first and second ends have a circular shape.

7. The warm air furnace of claim 6, wherein the first and second ends of the mounting flange are disposed substantially perpendicular to the at least one wall surface and are disposed adjacent to the inner wall surface of the at least one wall surface.

* * * * *